United States Patent [19]

Greve et al.

[11] 4,317,425

[45] * Mar. 2, 1982

[54] APPARATUS FOR APPLYING PLASTICIZER TO FIBROUS FILTER MATERIAL IN FILTER ROD MAKING MACHINES

[75] Inventors: Heinz Greve; Peter Grumer; Rolf Gömann, all of Hamburg, Fed. Rep. of Germany

[73] Assignee: Hauni-Werke Körber & Co. KG, Hamburg, Fed. Rep. of Germany

[ * ] Notice: The portion of the term of this patent subsequent to Jan. 2, 1996, has been disclaimed.

[21] Appl. No.: 191,286

[22] Filed: Sep. 26, 1980

Related U.S. Application Data

[63] Continuation of Ser. No. 956783, Nov. 1, 1978, abandoned, which is a continuation-in-part of Ser. No. 255,032, May 19, 1972, Pat. No. 4,132,189.

[30] Foreign Application Priority Data

| | | | |
|---|---|---|---|
| Jun. 2, 1971 | [DE] | Fed. Rep. of Germany | 2127293 |
| Sep. 20, 1971 | [DE] | Fed. Rep. of Germany | 2146897 |
| Dec. 1, 1971 | [DE] | Fed. Rep. of Germany | 2159428 |

[51] Int. Cl.[3] ..... B05C 5/00

[52] U.S. Cl. ..... 118/33; 118/325; 118/326; 118/DIG. 16

[58] Field of Search ..... 118/300, 672, 323, 674, 118/325, 326, DIG. 16, 44, 62, 33; 239/220, 222; 68/205 R

[56] References Cited

U.S. PATENT DOCUMENTS

| | | | |
|---|---|---|---|
| 275,957 | 4/1983 | Stonemetz | 118/325 X |
| 2,199,093 | 4/1940 | Wolfenden | 118/DIG. 16 |
| 2,736,289 | 2/1956 | Allen | 118/326 X |
| 2,775,952 | 1/1957 | Schur | 118/674 |
| 2,844,019 | 7/1958 | Schurmann et al. | 68/205 R |
| 2,865,325 | 12/1958 | Leston et al. | 118/DIG. 16 |
| 2,986,149 | 5/1961 | Vanbrakel | 68/205 R |
| 3,209,467 | 10/1965 | Taylor, Jr. | 28/283 X |
| 3,226,773 | 1/1966 | Poliyenko | 118/44 X |
| 3,387,992 | 6/1968 | Arthur et al. | 118/325 X |
| 3,566,451 | 3/1971 | Weigand | 28/283 |
| 3,741,846 | 6/1973 | Greve | 118/325 X |
| 4,132,189 | 1/1979 | Greve et al. | 118/325 X |

OTHER PUBLICATIONS

Fritz et al, Def. Pub. Search copy of SN752,052 filed 8/12/68, published in 8740G697 on 5/19/70 Def. Pub. No. T874,025.

*Primary Examiner*—John P. McIntosh
*Attorney, Agent, or Firm*—Kontler & Grimes

[57] ABSTRACT

A filter rod making machine wherein a continuous tow of fibrous filter material is flattened to form a foraminous layer prior to advancement through an impregnating station where a rotating brush sprays particles of atomized plasticizer against the underside of the layer. The brush is installed in the trough-shaped lower portion of a receptacle which flares upwardly and outwardly toward the underside of the layer and the bristles of the brush sweep along the internal surface of the lower portion of the receptacle. The lower portion receives a continuous stream of liquid plasticizer from the outlet of a variable-delivery pump whose intake receives plasticizer at a constant pressure. The brush is driven by an electric motor independently of the system which transports the layer of filter material.

9 Claims, 1 Drawing Figure

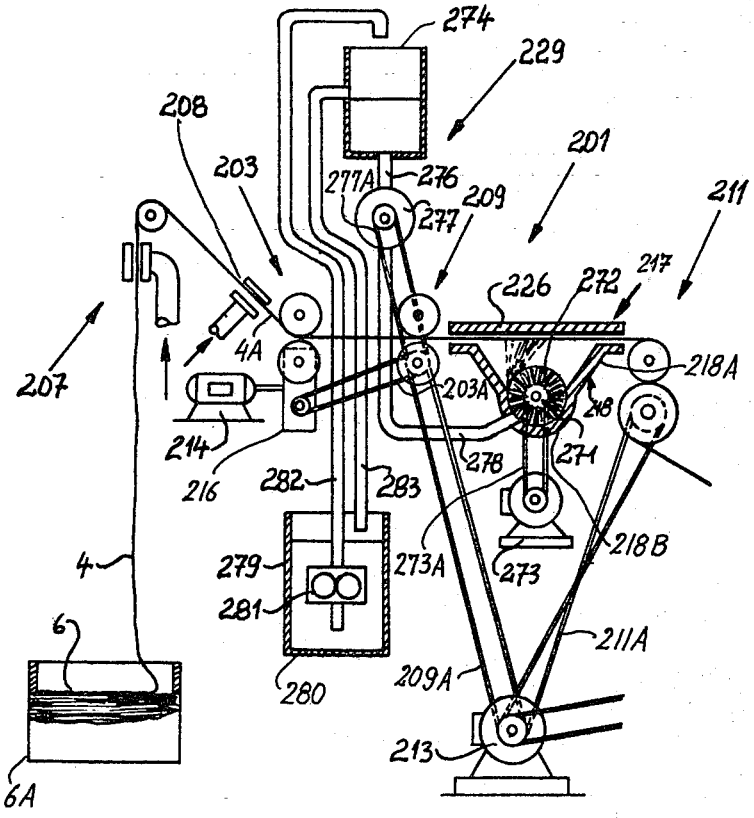
274
229
208
201
203
277A
276
209
211
277
226
272
217
207
4A
218A
203A
214
216
282
283
278
271
218B
4
279
273A
273
281
211A
6
280
209A
213
6A

APPARATUS FOR APPLYING PLASTICIZER TO FIBROUS FILTER MATERIAL IN FILTER ROD MAKING MACHINES

The present application is a continuation of application Ser. No. 956,783, filed Nov. 1, 1978, abandoned which in turn is a continuation in part of application Ser. No. 255,032, filed May 19, 1972 now U.S. Pat. No. 4,132,189.

BACKGROUND OF THE INVENTION

The present invention relates to machines for the production of filter rods for use in the manufacture of filter plugs or filter rod sections in the making of filter tipped cigarettes, cigars or cigarillos. More particularly, the invention relates to improvements in apparatus which are utilized in filter rod making machines to apply a liquid plasticizer to successive increments of a continuously moving tow of filamentary filter material.

A filter rod making machine comprises an advancing mechanism which draws a continuous tow of filamentary filter material from a bale and transports the tow lengthwise through an impregnating station where the filaments are contacted by particles of a liquid plasticizer or softening agent. Prior to entering the impregnating station, the tow is caused to pass through one or more so-called banding devices wherein the tow is converted into a layer so as to expose all or nearly all of its filaments during travel through the impregnating station. The impregnated layer is thereupon advanced through a gathering device (called horn) which converts the layer into a rod-like filler ready to be wrapped into a web of cigarette paper, imitation cork or other suitable wrapping material to thus complete the conversion of the tow and wrapping material into a continuous wrapped filter rod. The filter rod is severed at regular intervals to yield filter rod sections or plugs of unit length or multiple unit length. The tow normally consists of cellulose acetate fibers and the purpose of the plasticizer is to soften portions on the surface of each filament so that the thus softened portions adhere to each other and form an integral network of filaments which defines a maze of paths for tobacco smoke.

It is already known to supply plasticizer to the impregnating station at a rate which is proportional to the rate of transport of the layer of filamentary material. It is also known to employ a rotating brush as a means for atomizing the plasticizer and for propelling the particles of atomized plasticizer against one side of the moving layer of filamentary filter material at the impregnation station. Reference may be had to the Defensive Publication No. T874,005 of Fritz et al. published May 19, 1970. A drawback of presently known atomizing apparatus is that the application of atomized plasticizer is not uniform. The published article discloses an apparatus wherein a roller dips into a supply of liquid plasticizer and withdraws a film which is advanced into the range of bristles on a rotating brush. The latter propels particles of plasticizer against the moving layer of filter material. The uniformity or lack of uniformity of atomizing and plasticizer applying action depends on a number of unpredictable factors including the height of the supply of liquid plasticizer, the speed at which the roller and the brush rotate and certain others.

OBJECTS AND SUMMARY OF THE INVENTION

An object of the invention is to provide a filter rod making machine with a novel and improved apparatus which is capable of insuring uniform application of a liquid plasticizer to successive increments of a layer of fibrous filter material.

Another object of the invention is to provide the apparatus with novel and improved means for atomizing the liquid plasticizer and with novel and improved means for confining the atomizing means.

A further object of the invention is to provide the apparatus with novel and improved means for supplying liquid plasticizer to the atomizing means.

An additional object of the invention is to provide a simple, compact and inexpensive plasticizer atomizing and applying apparatus which can be installed in existing machines for the production of filter rods.

Another object of the invention is to provide an apparatus which does not waste any or wastes negligible amounts of liquid plasticizer.

A further object of the invention is to provide the apparatus with novel and improved means for establishing and maintaining a supply of liquid plasticizer in an optimum condition for atomization ahead of the impregnating station of the filter rod making machine.

A feature of the invention resides in the provision of an apparatus for applying liquid plasticizer to the filaments in layers of fibrous filter material. The apparatus comprises several sets of cooperating advancing rolls or analogous means for moving a layer of fibrous filter material along a predetermined path past an impregnating station at which one side of the layer faces downwardly, a tank or another suitable source of plasticizer, an atomizing device including a substantially funnel-shaped receptacle disposed below the path and tapering downwardly and away from the underside of the layer at the impregnating station, a rotary brush installed in the lower portion of the receptacle and having bristles which contact the inner surface of the lower portion of the receptacle during each revolution of the brush, an electric motor or other suitable means for rotating the brush, and means for supplying plasticizer from the source to the lower portion of the receptacle (i.e., into that portion which receives the bristles of the rotating brush) so that the bristles entrain, atomize and propel the thus supplied plasticizer against the underside of the layer in the path portion which extends through the impregnating station.

The supplying means preferably comprises means for delivering to the lower portion of the receptacle liquid plasticizer at a rate which is proportional to the rate at which the moving means advances the layer past the impregnating station. This is especially important when the rate at which the moving means advances varies, either at regular intervals or at random. The delivering means preferably comprises a metering device for liquid plasticizer, and such metering device may comprise a variable-delivery pump. It is further preferred to insure that the pressure of liquid plasticizer which is admitted to the intake of the pump be constant or fluctuate within a narrow range. This can be achieved by equipping the delivering means with a container having an outlet located at a selected level above and connected with the intake of the pump and with means for maintaining the pressure of liquid plasticizer at the outlet of the container at a substantially constant value. This can be achieved by connecting the container with an overflow pipe which insures that the container is invariably filled to a predetermined level regardless of the rate of withdrawal of liquid plasticizer by the pump.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE FIGURE

The single FIGURE of the drawing is a partly elevational and partly vertical sectional view of a portion of a filter rod making machine and of an impregnating apparatus which embodies one form of the invention.

DESCRIPTION OF THE PREFERRED EMBODIMENTS

The drawing shows a portion of a filter rod making machine which comprises a source of filamentary filter material here shown as a bale 6 which is stored in a box 6A and contains a supply of filter tow consisting of acetate fibers or the like. The tow is denoted by the reference character 4 and is withdrawn from the box 6A by a first pair of advancing rolls 203 which cause the tow to move between the components of two pneumatic banding devices 207–208 serving to convert the originally rope-like tow into a flat layer 4A wherein the filaments are located in a common plane so that each thereof can be contacted by finely atomized particles of a liquid plasticizer (e.g., triacetin) during travel of the layer 4A through an impregnating station 217 located downstream of the rolls 203 and defined by a filament impregnating apparatus 201 which embodies the invention.

The impregnating station is located between two additional pairs of advancing rolls 209 and 211 which form part of the filter rod making machine and define a substantially horizontal portion of the path for the layer 4A. Impregnated increments of the layer 4A advance beyond the station 217 and are caused to pass through the aforementioned gathering horn and thence into the wrapping mechanism of the filter rod making machine. Reference may be had to FIG. 1 and/or 2 of the aforementioned copending application Ser. No. 255,032 which is incorporated herein by reference. The peripheral speed of advancing rolls 211 preferably exceeds, at least slightly, the peripheral speed of the rolls 209 so that the filaments of the layer 4A are stretched during travel through the impregnating station 217, i.e., the filaments are uncrimped (either temporarily or permanently, depending upon whether or not they are stretched to the elastic limit of their material) so that they form a thin layer of parallel or nearly parallel filaments which are accessible to the finely atomized liquid plasticizer. Such plasticizer is applied to the underside of that portion of the layer 4A which is moved through the impregnating station by the advancing rolls 211.

The advancing rolls 211 (or at least the lower advancing roll 211) receive torque from the main prime mover 213 (e.g., a variable-speed electric motor) of the filter rod making machine through the medium of a belt or chain transmission 211A. The prime mover 213 further drives the advancing rolls 209 (or at least the lower advancing roll 209) through the medium of a second belt or chain transmission 209A. The lower advancing roll 203 receives torque from a belt or chain transmission 203A which is driven by the lower advancing roll 209 and drives the input element of a variable-speed transmission 216. The output element of the transmission 216 drives the lower advancing roll 203, and the ratio of this transmission can be varied by an electric motor 214.

The advancing rolls 203, 209 and 211 can be said to form a component part of the improved impregnating apparatus, namely, a means for moving the layer 4A toward, through and beyond the impregnating station 217 in such a way that one side of the layer 4A faces downwardly during travel through the impregnating station between the advancing rolls 209 and 211.

The purpose of the motor 214 is change the ratio of the speed of the rolls 203 and 209 and to thus select the degree of tensioning to which the filaments of the layer 4A are subjected ahead of the impregnating station 217. At least one of the advancing rolls 203 and 209 has a circumferentially grooved peripheral surface and the other of these pairs of rolls is preferably provided with a smooth peripheral surface on a layer of elastic material.

The impregnating apparatus further comprises a receptacle 218 which is substantially funnel shaped and has side walls 218A tapering downwardly and away from the underside of the layer 4A at the station 217. The lower portion 218B of the receptacle 218 constitutes or resembles a substantially semicylindrical trough for a rotary brush 217 whose axis is horizontal and extends transversely of the direction of advancement of the layer 4A through the impregnating station 217. The bristles 272 of the brush 271 contact the inner surface of the lower portion 218B during each revolution of the brush 271. The latter is rotated in a clockwise direction, as viewed in the drawing, by a discrete prime mover 273 and a belt or chain transmission 273A. The speed of this prime mover (e.g., an electric motor) can be varied independently of the speed of the prime mover 213 and/or the direction of rotation of the motor 214.

A stationary unperforated intercepting plate 226 is mounted at the impregnating station 217 at a level above the path for the layer 4A. The purpose of the plate 226 is to intercept atomized particles of plasticizer which penetrate through the foraminous layer 4A and to enable the filaments of the layer to entrain the intercepted particles in a direction toward the advancing rolls 211. This insures that each unit length of the layer 4A receives a predetermined quantity of atomized plasticizer and that such quantity is uniformly distributed between the filaments of the respective unit length. The upper side of the layer 4A slides along the underside of the intercepting plate 226.

The means 229 for supplying liquid plasticizer to the lower portion 218B of the receptacle 218 comprises a vessel or tank 279 which constitutes a main source of liquid plasticizer and contains a pump 281 (e.g., a gear pump) which causes a continuous stream of liquid plasticizer to flow from the supply 280 in the tank 279, through an upwardly extending conduit 282 and into an open-top receptacle or intermediate vessel 274 which stores a constant supply of liquid plasticizer at a level above a metering device 277 (preferably a variable-delivery pump) whose intake is connected with the outlet in the bottom wall of the container 274 by a conduit 276. A further conduit 278 connects the outlet of the pump 277 with the lower portion 218B of the container 218 so that the plasticizer which issues from the discharge end of the conduit 278 is immediately entrained and atomized by the orbiting bristles 272 and the particles of atomized plasticizer are propelled against the underside of the moving layer 4A at the impregnating station 217. In order to insure that the pressure of plasticizer at the outlet of the container 274 will remain constant, the apparatus 201 further comprises an overflow conduit 283 which communicates with the container at a level immediately above the desired level of intermediate supply of liquid plasticizer and delivers the surplus into the tank 279.

The pump 277 need not pressurize the plasticizer which is supplied via conduit 276 because the pressure of plasticizer at the outlet of the container 274 is constant and such pressure (due to the mounting of the container at a level above the lower portion 218B of the receptacle 218) suffices to insure that the liquid plasticizer will flow into the portion 218B and into the range of orbiting bristles 272 without further pressurization by the pump 277. The latter is driven by a belt or chain transmission 277A receiving motion from the lower advancing roll 209. Since the prime mover 213 drives the advancing rolls 209, 211 as well as the pump 277, the rate at which the pump 277 delivers metered quantities of liquid plasticizer to the lower portion 218B of the receptacle 218 is always proportional to the rate at which the filamentary material of the layer 4A is transported through the impregnating station.

The operation of the apparatus 201 is as follows:

The rolls 203 draw the tow 4 from the bale 6 at a constant rate and the tow 4 is converted into a flat layer 4A during travel through the banding devices 207 and 208. If desired, and as shown in FIG. 4 of the copending application Ser. No. 255,032, a banding device can be placed immediately downstream of the advancing rolls 209. The layer 4A is moved through the impregnating station 217 by the advancing rolls 211 so that its upper side slides along the underside of the intercepting plate 226 and its underside faces the open top of the receptacle 218.

The pump 277 supplies liquid plasticizer into the lower portion 218B of the receptacle 218 at a rate which is proportional with the rate of transport of filamentary filter material through the station 217, i.e., the quantities of plasticizer which are supplied per unit of time are proportional to the quantities of filter material which are moved through the impregnating apparatus during the same period of time. The bristles 272 of the rapidly rotating brush 271 convert the continuously supplied plasticizer into finely atomized particles which are propelled upwardly, i.e., against the underside of the moving layer 4A, and are entrained by the filamentary filter material. Any particles of atomized plasticizer which penetrate through the layer 4A impinge upon the underside of the intercepting plate 226 and are entrained by the filter material to thus insure that each of a series of unit lengths of the filter material carries identical quantities of plasticizer.

The improved apparatus has been found to be capable of insuring surprisingly uniform distribution of plasticizer in the material of the layer 4A. This is attributable to several factors including the feature that the conduit 278 delivers liquid plasticizer at a constant pressure directly into the range of orbiting bristles 272, the feature that the bristles 272 sweep along the internal surface of the lower portion 218B of the receptacle 218, to the feature that the pressure of plasticizer is constant irrespective of the rate at which the pump 277 delivers plasticizer to the receptacle 218, to the provision of a discrete prime mover 273 for the brush 271 and also to the provision of the non-permeable intercepting plate 226.

Uniform distribution of atomized plasticizer particles in the material of the layer 4A insures the making of a highly satisfactory filler for the filter rod, i.e., each unit length of the filler offers the same resistance to the axial flow of a gas therethrough.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for applying liquid plasticizer to the filaments in layers of fibrous filter material, comprising means for moving a layer of fibrous material along a predetermined path through an impregnating station at which one side of the layer faces downwardly; a source of plasticizer; an atomizing device including a substantially funnel-shaped receptacle having an open top facing said one side of the layer at said station, said receptacle including a lower portion and said atomizing device further including a rotary brush installed in said lower portion and having bristles contacting said receptacle during each revolution of said brush, and means for rotating said brush; and means for supplying liquid plasticizer from said source to said lower portion of said receptacle so that said bristles entrain, atomize and propel the thus supplied plasticizer against said one side of the layer at said station, said supplying means comprising means for delivering to said lower portion liquid plasticizer at a rate which is proportional to the rate at which said moving means advances the layer through said station.

2. The apparatus of claim 1, wherein said delivering means comprises a metering device for liquid plasticizer.

3. The apparatus of claim 2, wherein said metering device comprises a variable-delivery pump.

4. The apparatus of claim 3, wherein said pump has an intake and said delivering means further comprises a container for liquid plasticizer, said container having an outlet connected with the intake of said pump and said delivering means further comprising means for maintaining the pressure of liquid plasticizer at the outlet of said container within a predetermined range.

5. The apparatus of claim 1, wherein said lower portion of said receptacle is trough shaped and said brush is rotatable about an axis which extends transversely of said path.

6. The apparatus of claim 1, wherein said receptacle further comprises walls which diverge upwardly toward said one side of the layer at said impregnating station.

7. The apparatus of claim 1, wherein said means for rotating said brush comprises a first prime mover and further comprising a discrete second prime mover for said moving means.

8. The apparatus of claim 1, wherein said means for moving said layer comprises means for tensioning the filter material of said layer during travel through said impregnating station.

9. The apparatus of claim 1, wherein said layer has a second side which faces upwardly during travel through said impregnating station, and further comprising means for intercepting atomized particles of liquid plasticizer which penetrate through said layer, said intercepting means being located above and contacting said second side of the layer at said station.

* * * * *